US005251810A

United States Patent [19]

Kim

[11] Patent Number: 5,251,810

[45] Date of Patent: Oct. 12, 1993

[54] RE-MAILABLE ENVELOPE WITH DOUBLE SIDE ADDRESSING WINDOW

[76] Inventor: Myun H. Kim, 885 9th Ave., Apt. 2G, New York, N.Y. 10019

[21] Appl. No.: 839,836

[22] Filed: Feb. 21, 1992

[51] Int. Cl.[5] ..... B65D 27/04; B65D 27/06

[52] U.S. Cl. ..... 229/303; 229/71

[58] Field of Search ..... 229/302, 303, 71

[56] References Cited

U.S. PATENT DOCUMENTS

| | | | |
|---|---|---|---|
| 365,890 | 7/1887 | Weaver | 229/302 |
| 827,208 | 7/1906 | Boston | 229/305 |
| 1,128,862 | 2/1915 | Fitzgimmons | 229/309 |
| 1,151,442 | 8/1915 | Crull | 229/305 |
| 1,180,981 | 4/1916 | Cufal | 229/305 |
| 1,245,447 | 11/1917 | Felenchak | 229/301 X |
| 1,561,454 | 11/1925 | Ashby | 229/305 |
| 1,960,054 | 3/1934 | Johnson | 229/303 X |
| 2,396,543 | 3/1946 | Velazquez | 229/309 |
| 2,964,233 | 12/1960 | McFarland | 229/302 |
| 3,111,257 | 11/1963 | Peach | 229/302 |
| 3,270,948 | 9/1966 | Donovan | 229/302 |
| 3,392,908 | 7/1968 | Shelley et al. | 229/309 |
| 3,512,702 | 5/1970 | Pritchard, Jr. | 229/71 |
| 3,558,040 | 1/1971 | Krueger | 229/302 |
| 3,652,007 | 3/1972 | MacDougall | 229/304 |
| 3,693,869 | 9/1972 | Eaves, Jr. | 229/302 |
| 4,194,631 | 3/1980 | Rangan | 229/302 |
| 4,565,317 | 1/1986 | Kranz | 229/302 |
| 5,035,329 | 7/1991 | Kim | 229/309 |

FOREIGN PATENT DOCUMENTS

| | | | |
|---|---|---|---|
| 0070729 | 3/1950 | Denmark | 229/302 |
| 711690 | 10/1941 | Fed. Rep. of Germany | 229/71 |
| 2394460 | 2/1979 | France | 229/302 |
| 0029907 | of 1913 | United Kingdom | 229/305 |

*Primary Examiner*—Stephen P. Garbe

*Attorney, Agent, or Firm*—Schweitzer Cornman & Gross

[57] ABSTRACT

A remailable envelope having an address window for displaying the return address, first and second sealing flaps attached to opposite envelope panels, the first flap having tear line defining elements for initially opening the envelope without damaging the envelope or the second flap, the first flap being longer than the second flap and being long enough to cover the address window during the first mailing.

2 Claims, 3 Drawing Sheets

RE-MAILABLE ENVELOPE WITH DOUBLE SIDE ADDRESSING WINDOW

BACKGROUND AND SUMMARY OF THE INVENTION

The present invention is directed to a mailing envelope constructed to facilitate return mailing via the same envelope in which an original message is dispatched.

Multi-part envelope structures, designed to be reused by the original addressee for return to the original sender are in general well known. They are frequently used, for example, for sending of invoices, providing a convenient vehicle for return of payment to the sender. Known structures for this purpose, however, tend to be relatively complicated to construct and use, and frequently somewhat costly to manufacture. One example of such re-mailable envelopes is represented by the Blackman U.S. Pat. No. 5,025,980. That patent describes an envelope structure having a pair of overlapping closure flaps, one of which is used to seal the envelope for the first mailing, but is torn away by the addressee to gain access to the contents of the envelope. The second closure flap is folded over the opposite way and sealed to the opposite side of the envelope for return from the original addressee to the original sender. The prior art structures includes a tear-away front panel which carries the original address. Upon its removal, a window or other addressable area is exposed underneath.

The envelope structure of the present invention represents an improvement in the described prior envelope, both in terms of improved functionality, and in terms of economy of manufacture. In addition, the structure of the present invention is highly suitable for envelopes constructed of lightweight paper, whereas the prior art structure is more suitable for courier packages, for example, where the envelope is constructed of a heavier paperboard material.

In accordance with the present invention, an envelope structure is provided with front and back main panels foldably connected along the bottom edge of the envelope and sealed together at the opposite side edges, preferably by glue flaps. Each of the main panels carries at its upper edge a closure or sealing flap, one of which is longer than the other. Each of the flaps has a sealing margin along its free edge, provided with adhesive, with the adhesive area of the longer flap lying in an area which is beyond the free edge of the shorter flap.

In accordance with one feature of the invention, each main panel of the envelope is provided with an addressable area, most advantageously a window, for display of a destination address contained on the contents of the envelope.

In the envelope of the invention, the longer or first-used sealing flap is folded over the back panel of the envelope and sealed thereto for the first mailing. The original destination address is visible through a window on the front panel of the envelope. At the destination address, the first sealing flap is torn away along the top edge of the front panel to which it is hinged, and also at or adjacent its sealed free edge, in order to gain access to the contents of the envelope. For re-mailing, the orientation of the envelope is reversed and the address is provided on the original back panel of the envelope, most advantageously by display through a window provided thereon. The second sealing flap, hinged to the original back panel of the envelope, is folded over the original front panel and sealed thereto. In the process, the second sealing flap overlies and covers the original postage and cancellation marks.

In some constructions of the new envelope, the respective sealing flaps may be of such length as to extend down over and cover the unused address area of the envelope.

For a better understanding of the above and other features and advantages of the invention, reference should be made to the following detailed description of preferred embodiments, and to the accompany drawings.

DESCRIPTION OF THE DRAWINGS

FIGS. 5-14 9 are illustrations, as in cross section taken along line 5—5 of FIG. 1, of representative systems which may be employed for opening of the first sealing flap of the envelope.

FIGS. 10 and 11 are opposite side views of an envelope, similar to that of FIGS. 2 and 3, provided with a modified sealing flap arrangement.

DESCRIPTION OF PREFERRED EMBODIMENTS

Figure 1:
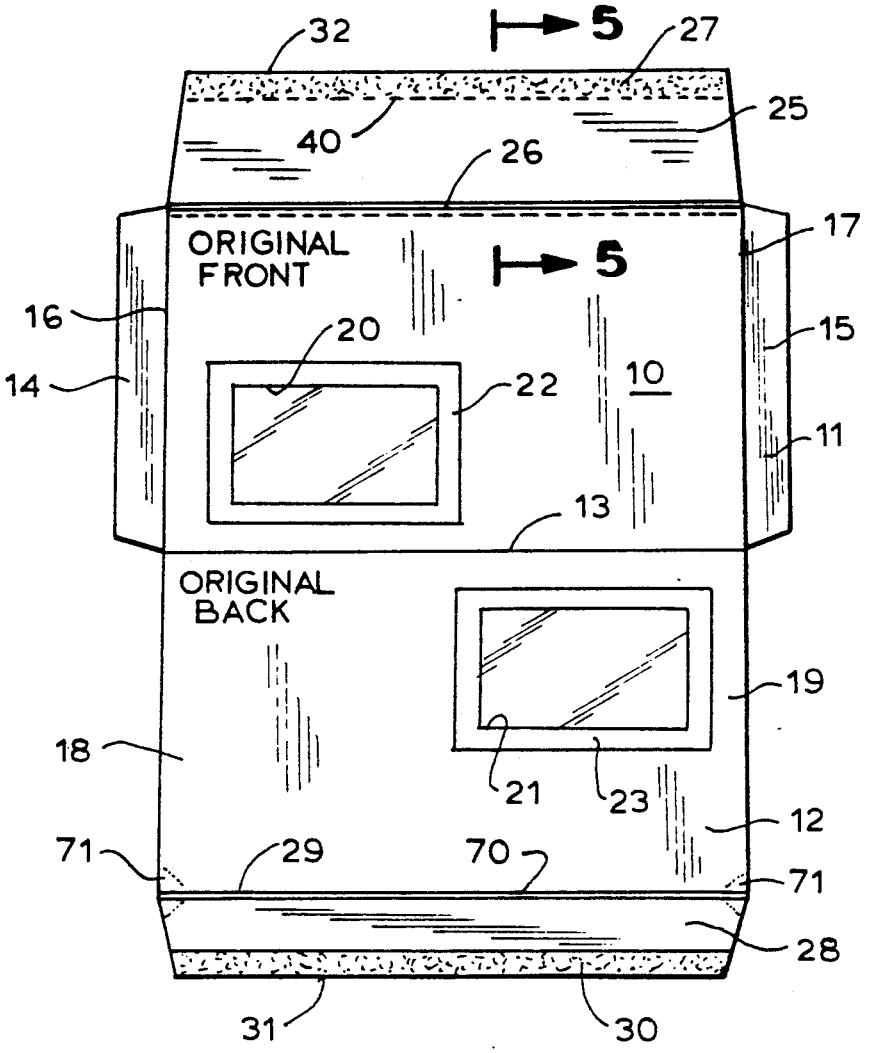
FIG. 1 is a plan view of a blank for a re-mailable envelope constructed in accordance with the invention.

Referring now to the drawing, the reference numeral 10 designates generally a cut blank for constructing a re-mailable envelope according to the invention. Typically and desirably, the blank will be formed of a suitable lightweight paper of normal envelope grade, either airmail or regular weight, although heavier stock may be employed if desired for special purposes. The blank includes main panels 11, 12 integrally joined along a bottom hinge line 13. The main panels 11, 12 form the front and back panels of the envelope, with the panel 11 constituting the original front panel, and the panel 12 constituting the original back panel of the envelope. The respective front and back panels 11, 12 are folded along the bottom edge fold line 13 and are sealed along their respective side edges to form an open top envelope pouch. Advantageously, short glue flaps 14, 15 are hinged along the opposite side edges 16, 17 respectively of one of the flaps (the front flap 11 in the illustration). These flaps are folded inward and adhesively joined to the confronting edge margins 18, 19 of the opposite main panel.

In its preferred and most advantageous form, each of the main panels 11, 12 is provided with an address display window 20, 21, and these typically will be closed by a transparent panels 22, 23 adhesively mounted on the inside surfaces of the panels 11, 12 around the periphery of the respective display windows. In the illustrated arrangement, the display windows are located in corresponding areas of their respective main panels (i.e. lower right-hand corner in the illustration). They may be located in any convenient manner, however.

A first sealing flap 25 is integrally attached to the top edge of the original front panel 11, along a fold-line 26. Adjacent its free edge, the first sealing flap 25 is provided with an area 27 of adhesive. This adhesive is applied to the "inside" surface of the paper, which is the surface visible in FIG. 1 of the drawings.

A second sealing flap 28 is integrally attached to the original back panel 12 along a fold line 29 at the upper edge of the panel. The second sealing panel also has an adhesive area 30 along its free edge, also on the "inside" surface of the envelope blank.

According to the invention, the overall length of the second sealing flap 28, from the fold line 29 to the free edge 31, is less than the distance from the fold line 26 of the first sealing flap to the adhesive area 27 of that flap.

To use the envelope for a first mailing, contents are inserted in the envelope in a manner to display the first destination address through the original front panel window 20. The first sealing flap 25 is then folded rearwardly over the upper portion of the original back panel 12. The second sealing flap 28 is also folded backward, over the top of the original back panel 12. The adhesive area 27 of the first sealing flap is then sealed to the outer surface of the panel 12, substantially in the manner shown in FIG. 2 of the drawing.

Figure 2:
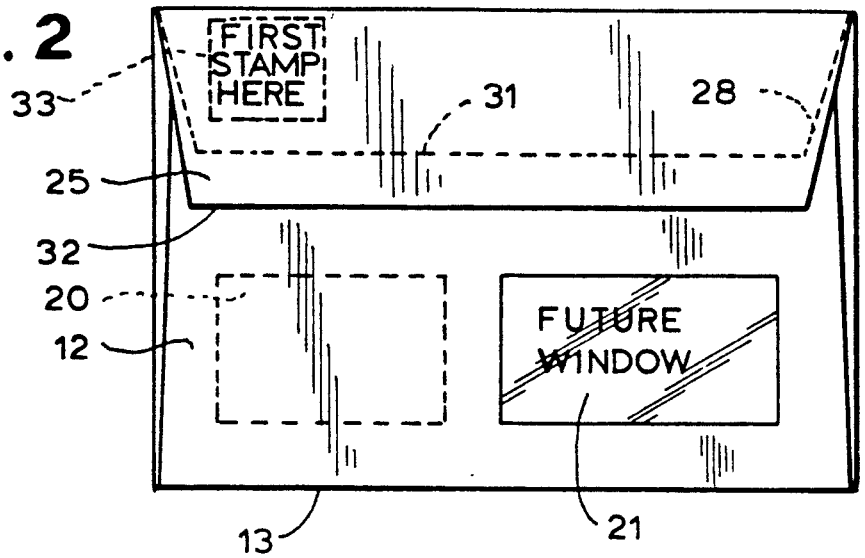
FIG. 2 is a view of the back side of a re-mailable envelope formed from the blank of FIG. 1 closed and ready for mailing.

As reflected in FIG. 2, the lower edge 31 of the second sealing flap lies well above the lower edge 32 of the first sealing flap, such that the entire adhesive area 27 of the first flap lies below the lower edge 31 of the second flap. The first address is displayed through the window 20 in the original front panel of the envelope. Likewise, the original postage is applied to the front panel 11, in an area generally indicated at 33 in FIG. 2.

For opening of the envelope at the first destination, tear means are provided, at least in the vicinity of the hinge line 26 and normally also along the inside edge of the adhesive area 27, so that the original sealing flap 25 may be cleanly removed along the top of the envelope. Typically, the adhesively attached lower margin of the flap, designated by the reference numeral 34 in FIG. 4, remains fixed to the panel 12. FIGS. 5–8 show typical and representative arrangements to facilitate clean removal of the sealing flap 25 by the first addressee. It should be understood, however, any of a huge variety of opening devices may be employed.

Figure 5:
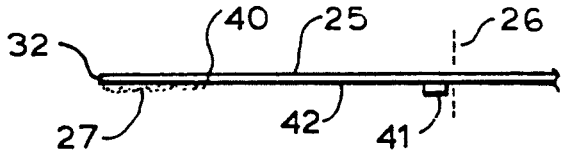

In FIG. 5, the sealing flap 25 is formed with a line of weakness 40 along the inside margin of the adhesive area 27. A tear strip 41, of relatively tougher material than the substance of the envelope, is bonded to the inside surface 42 of the flap. The tear strip 41 extends across the full width of the flap, and has one edge aligned adjacent the axis of the hinge 26, represented by a vertical dotted line in FIGS. 5–8. A strip of plastic material may be suitable for the tear strip 41. Its precise location is not significant, it may straddle the hinge line 26 if desired.

To open the envelope with the arrangement of FIG. 5, the tear strip 41 is drawn across the width of the envelope to free the upper edge of the flap 25. The flap can then be gripped and torn away along the line of weakness 40.

Figure 6:
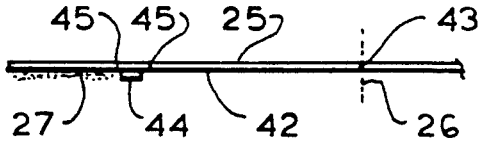

In the illustration of FIG. 6, the envelope flap 25 is provided with a line of weakness 43 generally coinciding with the axis of the hinge 26. A tear strip 44 is secured to inside surface 42 of the flap and extends across its full width adjacent the inner edge of the adhesive area 27. Lines of weakness 45, may be provided adjacent one or both side edges of the tear strip 44 to facilitate its removal. After the tear strip 44 is torn away, the freed envelope flap is then gripped and torn away along the line of weakness 43 at the hinge line.

Figure 7:
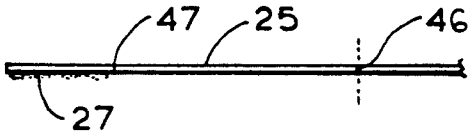

In the arrangement of FIG. 7, lines of weakness 46, 47 are provided at the upper and lower tear-away areas, allowing the flap 25 to be engaged at one side edge and torn free along the spaced lines of weakness 46, 47.

Figure 8:
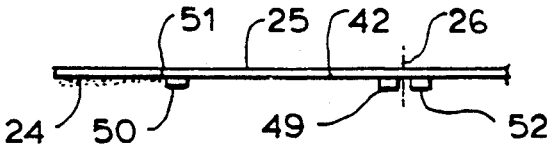

In the arrangement of FIG. 8, the sealing flap 25 is provided on its inside surface 42 with a pair of tear strip elements 49, 50 adjacent respectively the hinge line 26 and a line of weakness 51 adjacent the inside edge of the adhesive area 27. In the illustrated arrangement, a guide strip 52 is provided adjacent the upper tear strip 49 to confine the tear line. A line of weakness could also be employed, as will be understood.

Figure 9:
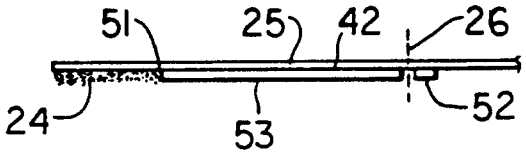

Instead of providing a widely spaced pair of tear strips 49, 50, it may be useful to provide a single thin flat plastic sheet 53, as shown in FIG. 9, with the opposite edges of the single plastic sheet performing the function of separate tear strips 49, 50.

Figure 3:
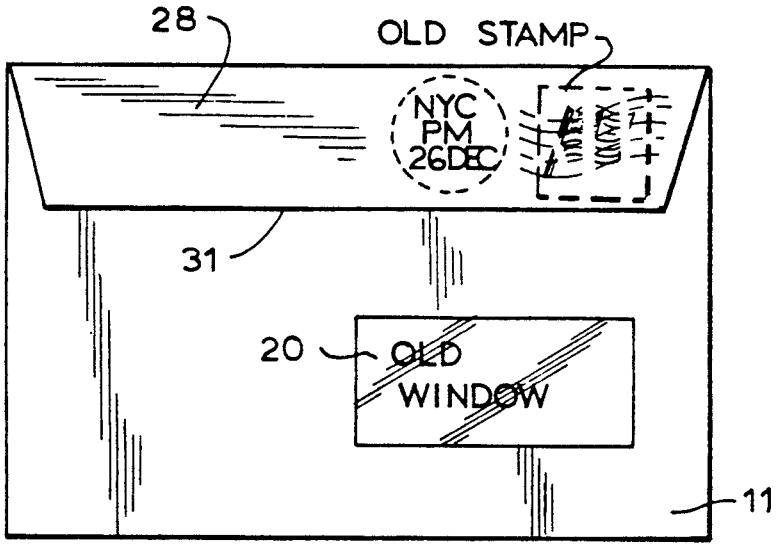
FIG. 3 is a view of the opposite side of the envelope of FIG. 2 after opening of the original envelope and preparation for re-mailing.

For re-mailing of the envelope after opening and removal of the first sealing flap 25, new contents are placed in the envelope, this time with the address information visible through the window 21 provided in the original back panel 12. The second sealing flap 28, attached to the original back panel (now the front panel) 12 is folded over the top of the envelope and adhesively secured to the original front panel 11. As shown particularly in FIG. 3, the second sealing flap 28, when folded over and sealed to the original front panel 11, covers over the original postage stamp or imprint and the related cancellation data.

Figure 4:
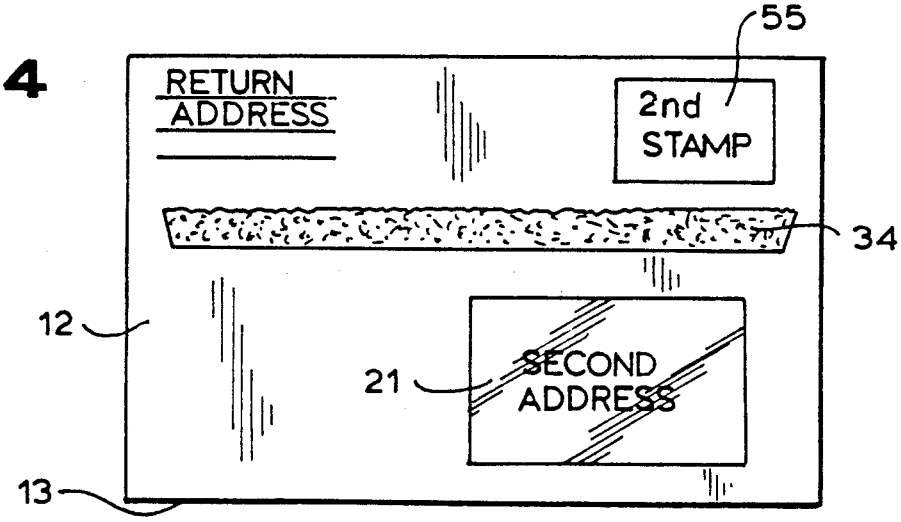
FIG. 4 is a view of the opposite or addressable side of the envelope of FIG. 3, in a form ready for re-mailing.

FIG. 4 of the drawing illustrates the front of the envelope prepared for the second mailing. The original back panel of the envelope now functions as the front panel and receives postage 55 in the usual location and with the second address visible through the window 21 provided in the original back panel. The window which remains on the opposite side of the envelope is unused and contains no address information.

With any of the opening arrangements illustrated in FIGS. 5–8, the front face of the envelope, in its re-mailing configuration, includes the adhesively attached strip 34 from which the balance of the first sealing flap 25 has been separated. In appropriate cases, the adhesive 27 used to secure the margin 34 may be of a releasable pressure sensitive type, enabling the strip 34 to be removed entirely from the panel 12. In such cases, it would not be necessary to provide for a line of weakness or a tear strip along the inside edge of the adhesive area, as in the examples of FIGS. 5–8.

To facilitate opening of the envelope by the second addressee, the second sealing flap 28 may be provided with a convenient tear opening feature, preferably in the vicinity of the hinge line 29. Conveniently, this can be in the form of a tear strip element 70 extending across the width of the sealing flap and provided with tear-away tabs 71 at each end, to facilitate gripping and pulling of the tear element 70. The specifics of the tear opening features for both flaps are not critical to the invention, although it is very desirable that some facility be provided to enable a clean opening of at least the first sealing flap 25.

In an advantageous modification of the invention, the first and second sealing flaps may be of sufficient length to cover substantial portions of the envelope main panels 11, 12. The relative length relationship of the first and second flaps would remain the same, of course, in that the first sealing flap is of sufficiently greater length than the second flap to enable the first flap to be sealed to the original back panel of the envelope.

Figure 10:
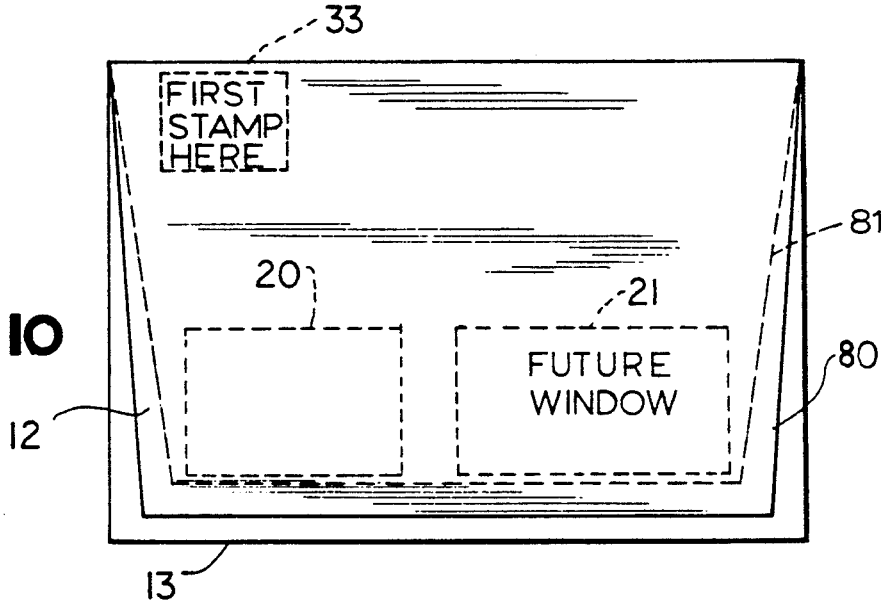
Figure 11:
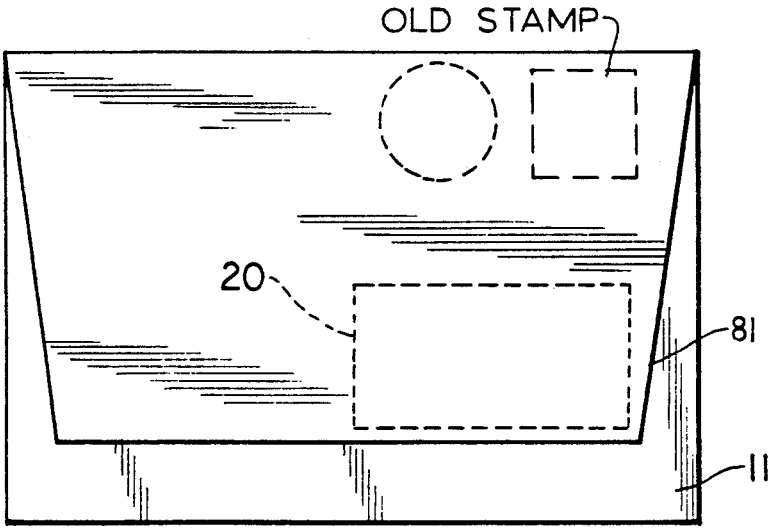

The modified arrangement is shown in FIGS. 10 and 11 of the drawing, where the broken line 80 represents the outline of the first sealing flap and the broken line 81 represents the outline of the second sealing flap. When the modified envelope is closed for its first mailing, as reflected in FIG. 10, the first sealing flap 80 is of sufficient length to cover the future address area otherwise exposed at the back of the envelope. In the re-mailing configuration, shown in FIG. 11, the second sealing flap 81 is of sufficient length to cover over the first address area as well as the original postage.

Particularly in the last described modification, it may be convenient to use pre-printed addressing and/or address labels on the envelope, inasmuch as the inactive address area is covered by the active sealing flap 80 or 81. Of course, address windows, such as the windows 20, 21, may also be employed. Desirably, such windows are located in an area to enable the inactive window to be fully covered by the active sealing flap 80, 81.

The structure of the invention represents a significant improvement in re-mailable envelopes, particularly with respect to its simplicity and economy of manufacture, and its ease of use.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A re-mailable envelope which comprises (a) first and second panels, each having bottom, side and top edges and inside and outside surfaces, (b) said first and second panels being joined at the bottom and side edges to form an envelope with an open top, (c) the outside surface of each said first and second panels having an area for the presentation of a mailing address and an area near the top for affixing postage, (c) a first sealing flap foldably connected to the top edge of said first panel along a first hinge line and a second sealing flap foldably connected to the top edge of said second panel along a second hinge line, (d) said first and second sealing flaps each having a free edge spaced from the respective first and second hinge lines, (e) said first sealing flap being of greater length than said second sealing flap whereby, when said first sealing flap is folded over against the outer surface of said second panel to close the top of said envelope, a predetermined free edge margin of said first sealing flap extends beyond the free edge of said second sealing flap, (f) securing means on said free edge margin for securing said first sealing flap to the outside surface of said second panel to close and seal said envelope for mailing, (g) said first sealing flap having tear line defining means adjacent said first hinge line to enable removal of said first sealing flap for opening of said envelope without damaging said panels or said second sealing flap, (h) said tear line defining means including a tear strip secured to an inside surface of said first sealing flap immediately adjacent said first hinge line and means adjacent one edge of and cooperating with said tear strip to define a line of severance substantially at said first hinge line, and (i) securing means on said second sealing flap for securing said flap to the outside surface of said first panel to close and seal said envelope for a further mailing, (j) said second sealing flap, when folded over and secured to said first panel, at least partially obscuring postage previously affixed to said first panel, (k) said second panel having a window therein for the presentation of a mailing address, (l) said first sealing flap being of sufficient length to cover said window.

2. A re-mailable envelope according to claim 1, further characterized by (a) said first panel having a window therein for the presentation of a mailing address, (b) said second sealing flap being of sufficient length to cover said second window.

* * * * *